US008698429B2

(12) United States Patent
Sadler et al.

(10) Patent No.: US 8,698,429 B2
(45) Date of Patent: Apr. 15, 2014

(54) LINEAR ACCELERATORS

(75) Inventors: Philip Sadler, Worthing (GB); David Harrison, Horsham (GB); Neil McCann, Burgess Hill (GB)

(73) Assignee: Elekta AB (publ), Stockholm (SE)

( * ) Notice: Subject to any disclaimer, the term of this patent is extended or adjusted under 35 U.S.C. 154(b) by 255 days.

(21) Appl. No.: 13/054,732

(22) PCT Filed: Jul. 18, 2008

(86) PCT No.: PCT/EP2008/005912
§ 371 (c)(1),
(2), (4) Date: Jan. 18, 2011

(87) PCT Pub. No.: WO2010/006630
PCT Pub. Date: Jan. 21, 2010

(65) Prior Publication Data

US 2011/0121763 A1 May 26, 2011

(51) Int. Cl.
*H05H 9/00* (2006.01)

(52) U.S. Cl.
USPC ..... 315/505; 315/500

(58) Field of Classification Search
USPC ..... 315/500–507, 39.53, 111.61
See application file for complete search history.

(56) References Cited

U.S. PATENT DOCUMENTS

| | | | | |
|---|---|---|---|---|
| 6,241,670 | B1 * | 6/2001 | Nambu | 600/427 |
| 2002/0181660 | A1 | 12/2002 | Reinstein et al. | 378/205 |
| 2005/0109939 | A1 | 5/2005 | Engler et al. | 250/336.1 |
| 2007/0076847 | A1 | 4/2007 | Pellegrino et al. | 378/97 |
| 2007/0248214 | A1 * | 10/2007 | Smith | 378/109 |

FOREIGN PATENT DOCUMENTS

| | | | | |
|---|---|---|---|---|
| CN | 1141202 | A | 1/1997 | A61N 5/10 |
| CN | 1901969 | A | 1/2007 | A61N 5/10 |
| JP | 07-014699 | A | 1/1995 | H05H 7/10 |
| JP | 07-014699 | A | 1/1995 | H05H 7/10 |
| JP | 2856029 | B2 | 2/1999 | H05H 13/04 |

OTHER PUBLICATIONS

European Patent Office; Authorized Officer: Crescenti, M.. *Notification of Transmittal of the International Search Report and the Written Opinion of the International Searching Authority, or the Declaration*, International Application No. PCT/EP2008/005912, mailed Jul. 17, 2009, 15 pages.

Kraft, et al., "*First Patients' Treatment at GSI Using Heavy-Ion Beams*," Proceedings of European Particle Acceleration Conference EPAC 98, vol. 1, No. 14, pp. 212-216, 1998.

(Continued)

*Primary Examiner* — Jimmy Vu
(74) *Attorney, Agent, or Firm* — Sunstein Kann Murphy & Timbers LLP

(57) ABSTRACT

There is provided a radiotherapy system comprising a linear accelerator, beam control circuitry for the linear accelerator, an electronic control apparatus for the control circuitry arranged to adjust properties thereof, and a monitor for detecting properties of the radiation beam produced by the linear accelerator, wherein the control apparatus is adapted to retain a set of beam properties and periodically activate the accelerator, measure the current beam properties via the monitor, compare the measured beam properties to the retained beam properties, and potentially adjust the control circuitry properties to align the beam properties towards the retained beam properties. The beam properties that are measured may include beam flatness and beam width. The retained beam properties can be the properties of the beam produced by the linear accelerator when new, or the properties of a standard beam. There is also provided a method for operating the system.

18 Claims, 7 Drawing Sheets

(56) References Cited

OTHER PUBLICATIONS

Martin, et al., "*Control System for ALID-7 Linear Accelerator Used in Radiation Processing*," Rev. Sci. Instrum., vol. 70, No. 7, pp. 2984-2987, 1999.
Masuda, et al., "*Event-synchronized Data Acquisition System for the SPring-8 Linac Beam Position Monitors*," Nucl. Instrum. Meth. A, vol. 543, No. 2-3, pp. 415-430, 2005.
Vieira, et al., "*Fast, Daily Linac Verification for Segmented IMRT Using Electronic Portal Imaging*," Radiother. Oncol., vol. 80, No. 1, pp. 86-92, 2006.
Woo, et al., "*Automatic Verification of Step-and Shoot IMRT Field Segments Using Portal Imaging*," Med. Phys., vol. 30, No. 3, pp. 348-351, 2003.
European Patent Office, European Examination Report, Communication pursuant to Article 94(3) EPC, Application No. EP 08 784 891.7, dated Apr. 26, 2013 (5 pages).
State Intellectual Property Office, Peoples Republic of China, First Office Action for Application 200880131169.3, dated Apr. 11, 2013 (12 pages).

* cited by examiner

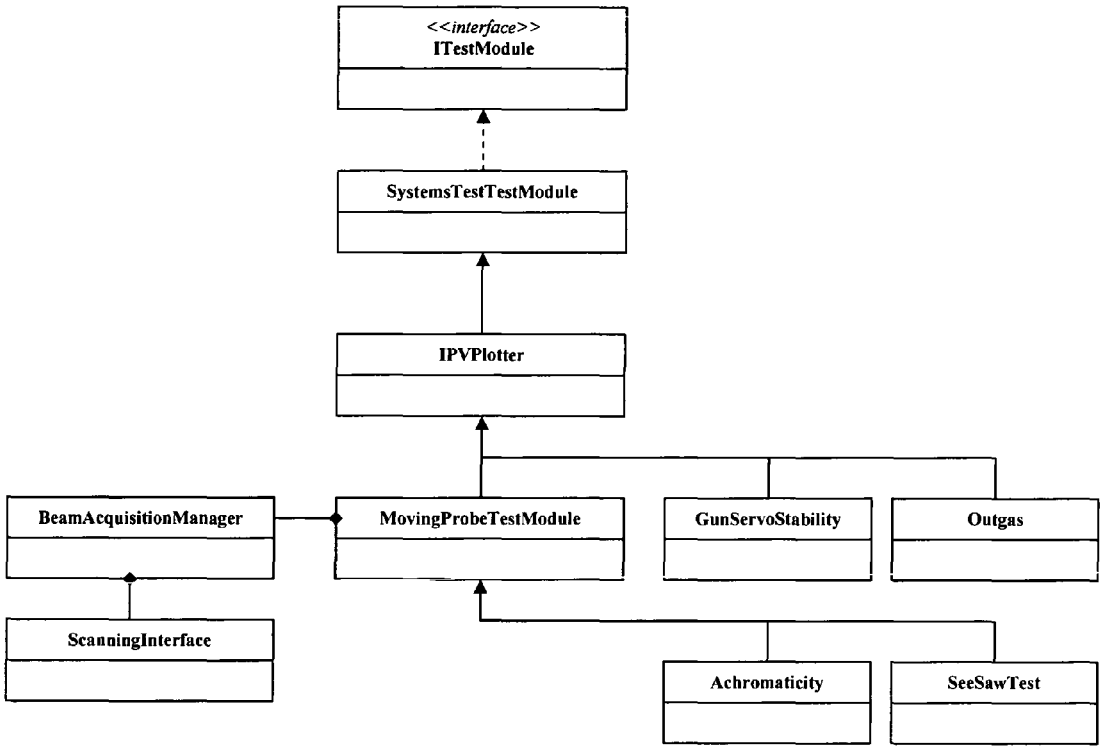
Fig 7
| String* strRecipient | TestModuleMessage* message |
|---|---|
| | |
| | |
| | |
| | |
Fig 8
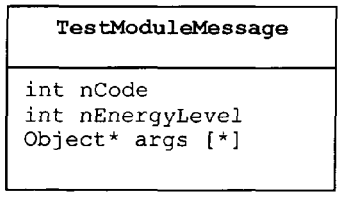
Fig 9

LINEAR ACCELERATORS

FIELD OF THE INVENTION

The present invention relates to the field of linear accelerators ("linacs"). It is especially, but not exclusively, concerned with such accelerators for medical usage.

BACKGROUND ART

Linacs are used to create high-energy beams of electrons and/or x-rays. These are useful in a wide range of circumstances, including for medical purposes. Such beams are harmful to tissue in their path, and therefore by careful collimation and control of the beam they can be used to deliver a radiation dose to (for example) a tumour in order to cause the tumour to stop growing or even die back.

If a significant amount of non-cancerous tissue receives a significant dose, this can cause side-effects. These are undesirable in principle, and will also limit the rate at which the tumour can be irradiated. This, in turn, reduces the efficiency of the treatment. For this reason, the dose applied to the patient is carefully controlled, and complex treatment plans are prepared in which the direction of irradiation, the collimation of the beam, and the beam intensity are all varied with time in an interrelated manner in order to build up a desired three-dimensional dose distribution in the patient. These treatment plans are prepared by a treatment planning computer which models the interaction of the beam and the patient.

This process requires that the properties of the beam be well characterised, and that the beam continues to conform to that characterisation over the long term. An international standard exists which lays down ranges of permissible parameters for the beam, but these ranges are relatively wide and nominally identical linear accelerators may produce beams that all fall within the standard but which have measurably different properties.

Thus, the properties of the beam produced by a specific linear accelerator will usually be characterised prior to bringing the linear accelerator into service, and those properties used to define the beam model employed by the treatment planning computer. To confirm that the beam is still behaving according to the model, routine checks are carried out over time. Typically, there is a brief daily check, a slightly more thorough weekly check, and a more involved monthly check.

SUMMARY OF THE INVENTION

As a result of these constraints, the process of bringing a new linac into service can be very lengthy. The linac must be physically delivered and installed into its desired location, and the necessary power, water and data lines connected. The beam properties must then be measured and checked against the standard to confirm that the linac has not been damaged in transit, and to characterise the properties of the beam. These properties (sometimes referred to as the "signature" of the beam) must be transferred to the treatment planning computer to create a digital model of that beam for use in preparing treatment plans. That model then needs to be checked in order to confirm its accuracy; this involves the preparation of a number of sample dose distributions which are then delivered by the linac to a test phantom in order to confirm that the linac is behaving as expected.

This process of characterisation and testing can take up to six months. During this time, the linac is not available for treatment of patients, which is (clearly) inconvenient for the clinic and for patients.

We therefore propose that during the factory testing of the linac, rather than simply confirming that the beam falls within the permissible ranges set out in the standard, the beam is in fact adjusted towards a standard signature. This standard signature could then be published for use by writers of treatment planning software. As a result, while there may be small differences between the actual signature of the beam and the standard signature, these will take less time to characterise and test and therefore the linac can be brought into service more quickly.

This also raises the prospect of preparing a plurality of linacs in or for the same clinic that have matched beams. A new (or existing) linac could be paired to a new linac, or to an existing linac, such as one that it is to operate alongside or one that it is to replace. Treatment plans would then be transferable between such pairs of linacs, thereby allowing greater flexibility in booking patients for treatment or allowing existing treatment plans to be used on the new linac.

In addition, the standard signature to which the linacs were approximated could be placed towards the centre of the permitted ranges. This could produce linacs that were more reliable over the very long term.

This requires a linac that has automatically adjustable parameters, so that a suitable programmed computer is able to monitor the output of the linac and adjust its operating parameters. This means the computer is able to try a wide range of permitted adjustments to the linac before opting for that combination which approximates most closely to the published standard.

This also raises the prospect of fuller testing while the linac is in service. As mentioned above, a degree of routine testing is already carried out. However, if the linac is provided with a suitable detector for the beam properties then a fuller routine test could be carried out, for example overnight while the clinic is closed. Such a detector could be fitted to the linac by an operator after completion of the last treatment of the relevant clinical session, or it could be carried by the linac continuously. In the latter case, the detector could be mounted in the beam path or it could be fitted to an extendable arm to allow it to be moved into the path of the beam when required. Some linacs are fitted with flat panel detectors for the beam, to capture portal images during treatment; while these are not optimised for beam testing, they may be useable for some purposes.

The present invention therefore provides a radiation source comprising a linear accelerator, beam control circuitry for the linear accelerator, an electronic control apparatus for the control circuitry arranged to adjust properties thereof, and a monitor for detecting properties of the radiation beam produced by the linear accelerator, wherein the control apparatus is adapted to retain a set of beam properties and periodically activate the accelerator, measure the current beam properties via the monitor, compare the measured beam properties to the retained beam properties, adjust the control circuitry properties to align the beam properties towards the retained beam properties.

These steps could, for example, follow after a period of normal operation and may be followed by a further period of normal operation, after which they may be repeated.

The beam properties that are measured may include at least one of beam flatness and beam width.

The retained beam properties can be the properties of the beam produced by the linear accelerator when new, or the properties of a standard beam.

The control apparatus is preferably arranged to send a message if the difference between the measured beam properties and the retained beam properties exceeds a threshold. It may also send a message to a remote location if the difference between the measured beam properties and the retained beam properties exceeds a second, more demanding, threshold.

BRIEF DESCRIPTION OF THE DRAWINGS

An embodiment of the present invention will now be described by way of example, with reference to the accompanying figures in which;

FIG. 7 shows the Test Module class relationships;
FIG. 8 shows the Test Module Message Table;
FIG. 9 shows the TestModuleMessage.

DETAILED DESCRIPTION OF THE EMBODIMENTS

1 Introduction

Referring to the accompanying figures, we will now describe our "Autotest" software and the relationships between its individual components, before going on to describe how this might be used in practice.

2 Overview

The Autotest software contains one executable file and several dynamic link libraries (DLLs) that fit together to produce a suite of test tools for shelter or in-use testing. By "shelter testing", we mean the testing of a new linac that takes place immediately after manufacture. Generally, after assembly the new linac will be placed in a radiation-shielded area referred to as a "shelter", within which it can be operated safely during initial testing.

To accomplish this, the software needs to be able to communicate directly to the Linac and also to scanning equipment placed in the beam that provides data characterising the beam. The Autotest software controls the linac via the Desktop Pro control system; two components are used to control the Linac—the TestInterfaceClient and the FKPModuleInterface. The latter communicates with a Function Key Pad (FKP) device which enables software control of particular buttons of the actual (physical) FKP. Communication with the linac is achieved by adjustment of control circuit parameters referred to as Item Part Values or IPVs. The Autotest software also controls the scanning equipment. Both the TestInterfaceClient and the ServoClient are lower level components, and as such only a brief description of each is provided herein.

3 The Main Components

Figure 1:
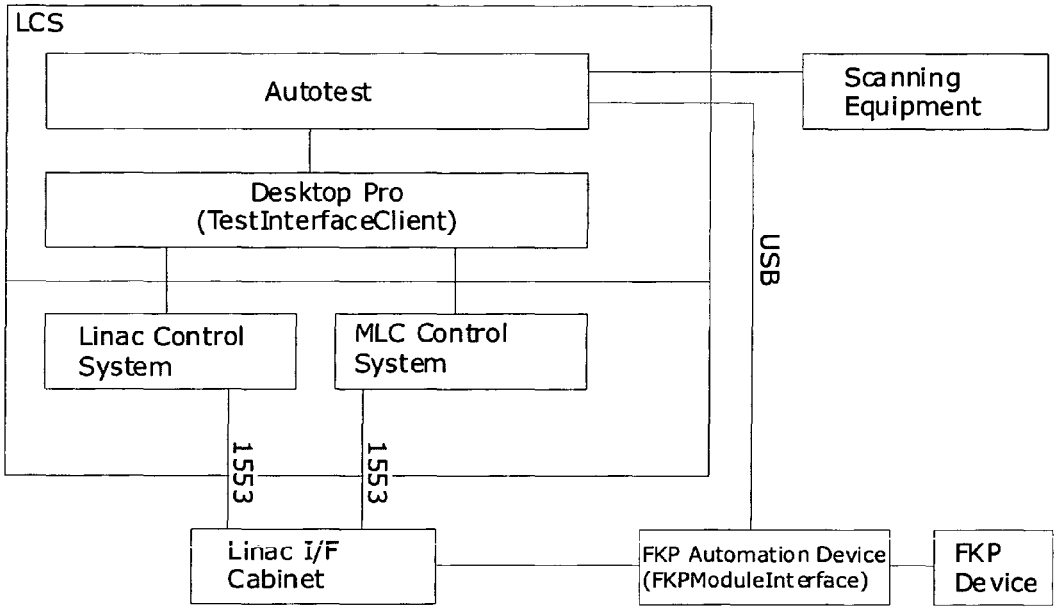
FIG. 1 shows the main components of the system.

What could be considered the main components of this system are shown in FIG. 1 and described below. These allow communication to the hardware, and provide the main user interface.

3.1 TestInterfaceClient

Desktop Pro provides a software interface to the Autotest software to determine the linear accelerator energy configuration, configure and start beams, read and write linear accelerator item part value and resolve item part names in the Linac database.

Desktop Pro itself communicates with the Linac and MLC control systems to control the actual Linac and MLC The TestInterfaceClient thus acts as a facade in order to reduce the complexity of interfaces to the main linac software. The accompanying classes in the DLL are helper classes only:

| Class | Purpose |
|---|---|
| TestInterfaceClient | The main component. This permits clients to determine the linear accelerator energy configuration, configure and start beams, read and write linear accelerator item part value and resolve item part names in the Linac database. It uses the FieldParameters class in order to load in the beam parameters, and the MachineItem class when subscribing and unsubscribing to item parts. This class also allows the client to load the MLCDisplay OCX control for viewing the MLC shape. |
| FieldParameters | Contains the leaf positions and beam parameters needed in order to set up a beam for radiation. The BeamParametersHaveChanged property gives a crude way of determining when the user interface has changed the beam parameters. |
| MachineItemClass | used by the TestInterfaceClient for inserting item parts into a hashtable in order to keep track of how many subscribers there are to a particular item part. |

3.2 FKPModuleInterface

This permits communication to a USB function keypad ("FKP") device that permits the linear accelerator to be enabled by the control apparatus without user action. It provides methods such as ActivateStartButton and SetASUAndAutoButtons that have a direct correlation to the hardware buttons on the device itself.

As a safety feature, the FKPModuleInterface also periodically sends a sync message to the FKP hardware so that if the software crashes, the linear accelerator is disabled. This message is sent on a separate thread in order to ensure regular intervals without disruption by messages sent to the GUI. The physical device also has a key-switch and an 'activate' button to enable it before it can be used.

Although the hardware connects via a USB port, the drivers that are installed allow communication as though the FKP- Device was connected to a serial port. The SerialPort class acts as the lower level interface to the serial port whilst the FKPModuleInterface class is used directly by New Autotest.

This hardware device thus provides a USB interface for the Autotest software, to facilitate software control of the radiation beam and to allow Assisted Set Up (ASU) to be performed without a user having to be present to physically press the buttons on the Function Key Pad.

3.3 ServoClient

The ServoClient, part of the Autotest software, is present in order to provide access to the detector via a serial port. The ServoClient component is a dll that runs in the Autotest software process space whilst the separate component runs in its own process space.

3.4 New Autotest GUI

The New Autotest GUI is essentially the 'glue' that holds the system together. It has been designed to run in two ways:

On a closed or locked system connected to a Linac.

On a desktop PC.

When run on a desktop PC, the software is launched by the user double-clicking the executable file, in the same manner as a user would launch any other program. When run on a closed system connected to a Linac, New Autotest is launched via the NewAutotestLauncher component described in section 7.

Whilst it is difficult to give a meaningful description of the software without any knowledge of its constituent classes, it is also difficult to attach any usefulness to such classes without first knowing their interactions. Therefore, a brief overview of the main classes and their interactions is initially presented followed by a more thorough description of each class in subsequent sections.

Figure 2:
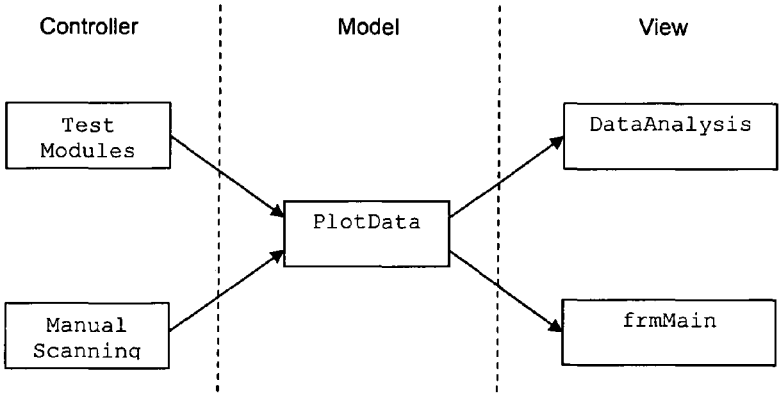
FIG. 2 shows the main software architecture.

The main software has been designed around a Model-View-Controller architecture with the plot data acting as the Model, the GUI acting as the View and the test modules and manual scanning routines acting as the Controllers. This is presented in FIG. 2.

The test modules and any manual scanning update the PlotData class by methods such as AddPlot, LoadFile, SmoothData, SetXAndYAxisArrays, etc. The PlotData class can then inform the views that the data has changed by sending events i.e. OnPlotAdded, OnDataAppended, OnAllPlotsDeleted, etc.

The PlotData class implements low-level data interrogation and manipulation producing plot data, which can then be used and presented to the user by the DataAnalysis control.

4 Beam Data Acquisition Components

These components are the main helper classes for the project. They provide no user interface but deal with file manipulation, running tests, storing data and providing access to the scanning hardware.

4.1 BeamAcquisitionManager

The BeamAcquisitionManager utilises the Factory design method in order to instantiate the required components for interfacing with the Beam Acquisition hardware. The components that it creates are:

| Class | Purpose |
|---|---|
| ManualScanningMenu | To allow the user to interact with the scanning hardware via a menu control. |

-continued

| Class | Purpose |
|---|---|
| ManualScanningPage | To allow the user to interact with the scanning hardware via a user control that can reside on the New Autotest optional monitor. |
| ManualScanningToolbar | To allow the user to interact with the scanning hardware via a toolbar control. |
| ScanningInterface | To provide an interface to the scanning hardware. Described in section 4.2. |

Figure 3:
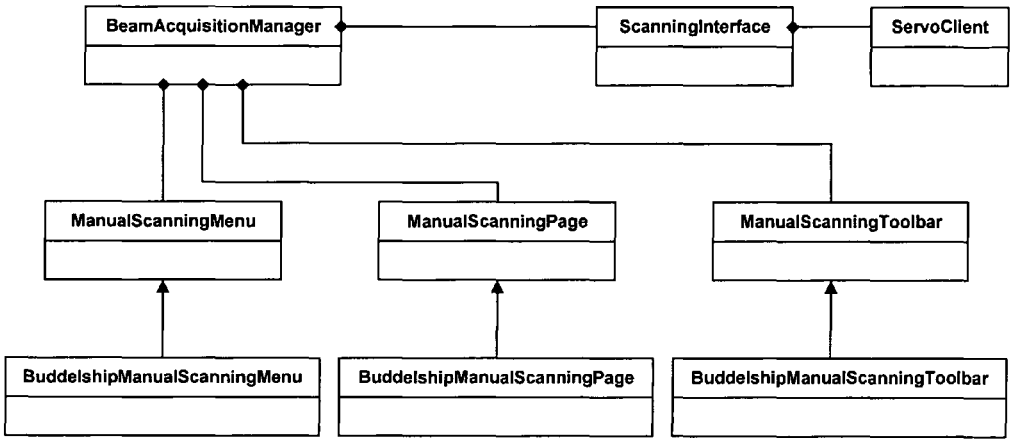
FIG. 3 shows the BeamAcquisitionManager Associations.

These associations are shown in FIG. 3.

Future developments of the New Autotest software will involve using alternative hardware for Beam measurement, therefore, it is important that a flexible means of communication to the scanning hardware is provided. The first three classes in the above table are essentially abstract classes that permit the New Autotest GUI to load in controls that allow the user to interact with this hardware.

The BuddelshipManualScanningControls library contains bespoke implementations of the required user interface controls needed to specifically control the 'Buddelship' (i.e. the scanning equipment). As can be seen from FIG. 3, these classes inherit directly from the manual scanning controls listed above.

The BeamAcquisitionManager class itself has been implemented as a Singleton within the scope of the NewAutotest process space. This permits components to access the scanning hardware without the need for passing references to it between classes.

4.2 ScanningInterface

Figure 4:
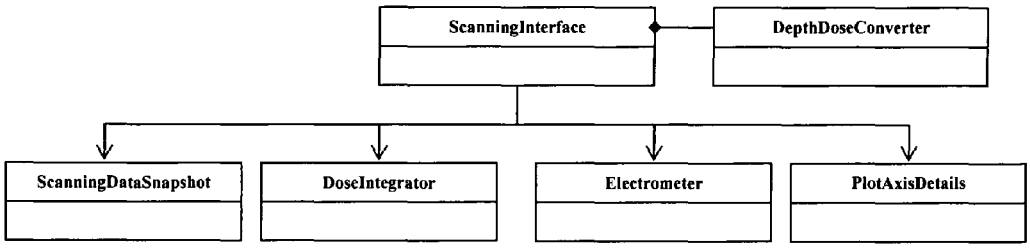
FIG. 4 shows the ScanningInterface classes.

It is envisaged that this class will eventually provide a bridge between the Autotest software and the scanning component (which at present is the ServoClient). As it stands, the ScanningInterface merely acts as a wrapper around the ServoClient component, thus providing the only means of accessing beam data. As new detectors become available, the ScanningInterface can be adapted to provide a more abstract bridge between New Autotest and the detector. The ScanningInterface uses a number of classes to interact with the hardware as shown in FIG. 4.

5 Test Module Classes 5.1 Overview

Figure 5:
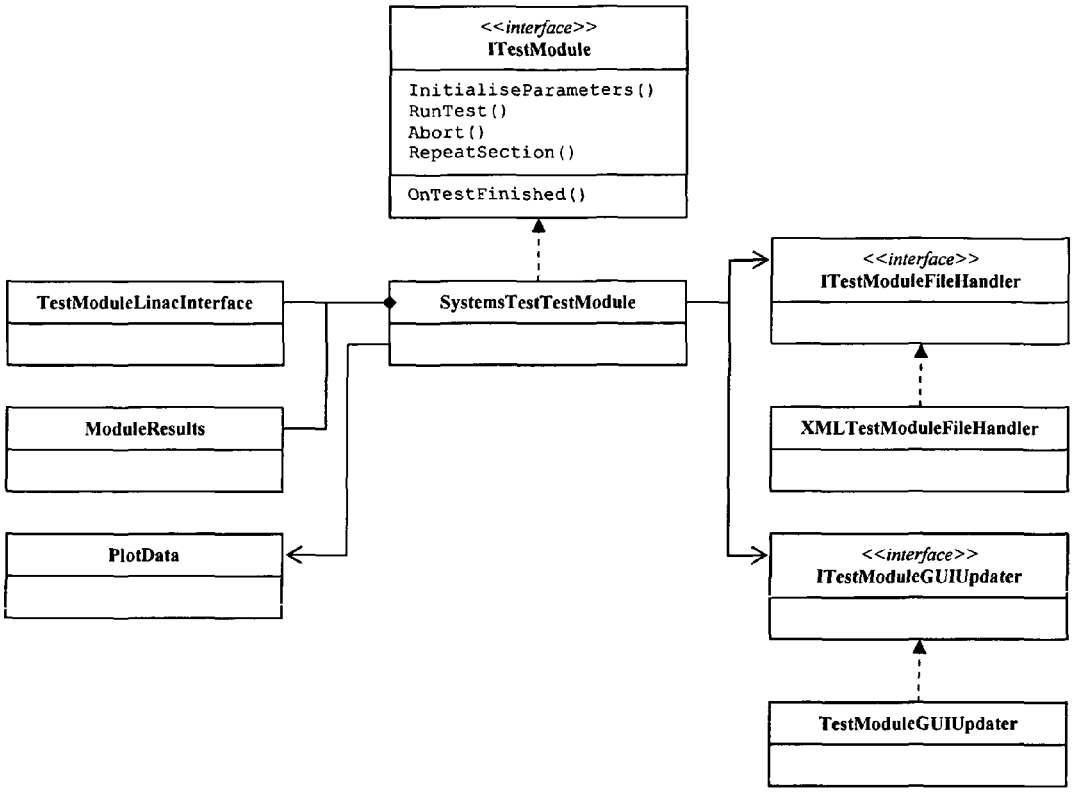
FIG. 5 shows the SystemsTestTestModule classes.
Figure 6:
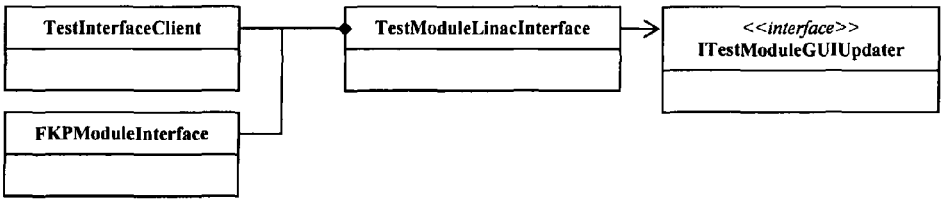
FIG. 6 shows the TestModuleLinacInterface.

All test modules implement an interface referred to as ITestModule. At present, most test modules accomplish this by inheriting from a SystemsTestTestModule class that provides common functionality to all test modules required by the Systems Test department. This common functionality is provided by the composition of classes shown in FIG. 5. The classes shown provide the following functionality:

| Class | Purpose |
|---|---|
| TestModuleLinacInterface | Uses the TestInterfaceClient and FKPModuleInterface class to interact with the Linac. It provides functions such as setting beam parameters, enabling the ASU and setting IPVs. The TestInterfaceClient is not thread-safe and so this class also ensures TestInterfaceClient methods are called on the correct thread. This class is shown again in FIG. 6. |
| PlotData | Contains the plot data for the test module. Please refer to section 7.1 below. |
| ModuleResults | Contains the module results. |
| ITestModuleFileHandler | Provides access to file handling facilities. At present, the interface is implemented by a class that writes to XML files. |
| ITestModuleGUIUpdater | Handles the interface to the GUI. |

FIG. 7 shows a more complete hierarchy from the ITestModule interface to the test modules themselves. Additional functionality is provided further down the hierarchy by the IPVPlotter and MovingProbeTestModule classes. The IPVPlotter contains methods that permit item part values to be plotted against each other. The MovingProbeTestModule class uses the BeamAcquisitionManager to provide a reference to the ScanningInterface and so contains methods for plotting beam profiles using the scanning equipment. It is envisaged, at a later date, that an additional class (ChamberArrayTestModule) will be used to provide common functionality for test modules that need to interface to the ion chamber array panel.

Each test module is implemented as a separate DLL that has the same name as the test that it represents; i.e. Outgas.dll contains the class Outgas and Achromaticity.dll contains the class Achromaticity. This method of implementation permits the main GUI to dynamically load in the module, cast it to an ITestModule type, and then use polymorphism to set the test parameters and run the required test. The loading of the test module occurs in frmMain::LoadTestModule:

```
//Get the class name for this module - this is the name without any spaces,
hyphens, commas, etc:
String *strClassName = TestModuleNameResolver::ConvertToClassName(strModuleName);
//Load the required module dll from the specified folder:
Assembly * ad = Assembly::LoadFrom(String::Concat(m_strRootDirectory, S"\\Autotest
Module dlls\\", strClassName, S".dll"));
//Create an instance of the test module:
m_pCurrentTestModule = _try_cast<ITestModule*>(ad-
>CreateInstance(String::Concat(S"NAComponents.", strClassName)));
//Set the required parameters for the test module:
m_pCurrentTestModule->InitialiseParameters(objParameters);
//Run the actual test - this is a virtual function in the generic TestModule class,
so that
//the method will actually run in the derived class (which is the actual test
module):
m_pCurrentTestModule->RunTest( );
```

The virtual RunTest method in each test module starts the actual test in a separate thread. This presents a problem with regards to writing item part values via the TestInterfaceClient and updating the Autotest GUI. Updating the GUI should always occur on the UI thread, and the TestInterfaceClient::WriteIPV method can only be called on the same thread that instantiated the TestInterfaceClient. To resolve this, delegates are created that permit these methods to be invoked on the correct thread within the TestModuleLinacInterface and TestModuleGUIUpdater class.

6 Test Module Communication

The TestModuleMessages library can be used to allow test modules to communicate with one another within a sequence. Inherently, all test modules are independent of each other and test modules within a test module sequence have no knowledge of each other. There are three main cases where components may need to exchange information:

- An instance of a test module may need to communicate with an instance of a different test module further in the sequence.
- One instance of a test module may need to communicate with another instance of the same test module further in the sequence.
- A derived class of NewAutotestModuleForm for one test module may need to pass parameters to a different derived class of NewAutotestModuleForm for a different test module.

6.1 Test Module Message Architecture

The overall mechanism comprises of a table of messages that components can create for others to access. This functions in a similar manner to the pigeon holes at a hotel reception with components 'leaving' messages for other components to 'read'.

The main components are the TestModuleMessageTable and the TestModuleMessage classes. The TestModuleMessageTable class is used to house a table of messages where each message is stored as a TestModuleMessage for a particular recipient. This is shown conceptually in FIG. 8.

Each 'row' in the table can contain a string relating to the recipient name and energy level, along with an instance of a TestModuleMessage that contains the message code and any arguments required. This message is shown in FIG. 9.

The table can be populated by a component sending a TestModuleMessage to the table class along with the required message recipient. Other components can then interrogate the table to see if any messages are waiting for them. Messages can be sent to and retrieved from the table thus:

```
void TestModuleMessageTable::AddMessage(String* strRecipient, TestModuleMessage*
pMessage);
TestModuleMessage*    TestModuleMessageTable::CheckMessages(String*    strRecipient)
_gc[ ];
```

Internally, the data will be stored in a Hashtable with the Recipient string and its corresponding TestModuleMessage constituting each key-value pair.

6.2 Creating the Message Table

The message table, if required, is created after the test module sequence has been defined by the user and just before the sequence is run. The test module table can then be created with the test sequence information. This allows test modules or their parameter forms to make decisions based on what else is about to be run in the sequence.

6.3 Accessing the Table

Figure 10:
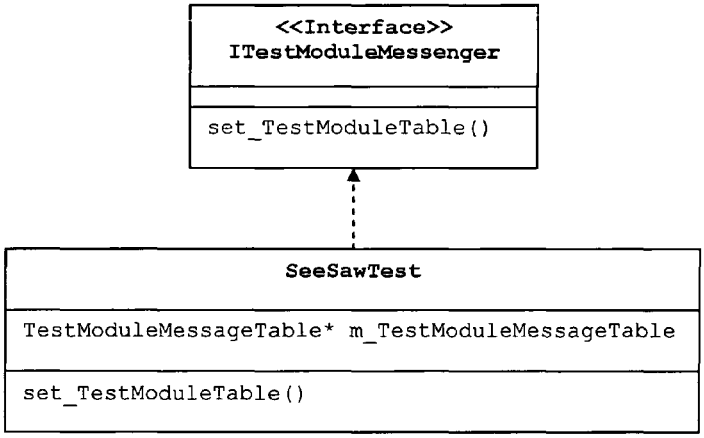
FIG. 10 illustrates the process for implementing ITestModuleMessenger interface.

In order for components to send or receive messages, they must be allowed access to the message table. It is proposed that a separate interface is created that allows an instance of the test module table to be set. Test modules (or other components) can then implement this interface so that the main Autotest form from the GUI can pass a table reference to them as shown in FIG. 10. The set_TestModuleTable property will be invoked by the main Autotest GUI form after the test module has been dynamically created and tested to see if it supports the ITestModuleMessenger interface.

Passing a TestModuleMessageTable reference to the required component allows that component to examine which test modules are set to run in the sequence. This gives a NewAutotestModuleForm the opportunity to remain hidden if a similar form is to be shown later on.

7 Other Ancillary Components 7.1 PlotData

The PlotData.dll contains a set of classes designed to store and analysis all plot data. The PlotData class itself provides the lower level data manipulation and analysis such as:

| Function | Purpose |
|---|---|
| get_MinYValue | Returns the minimum Y value on found on the given plot. |
| FirstXValueAtYValue | Searches the plot for the required Y value, and returns the value of X where this Y value first occurred. |
| TiltBetweenPoints | Returns the maximum tilt between two points on a plot. |

Figure 11:
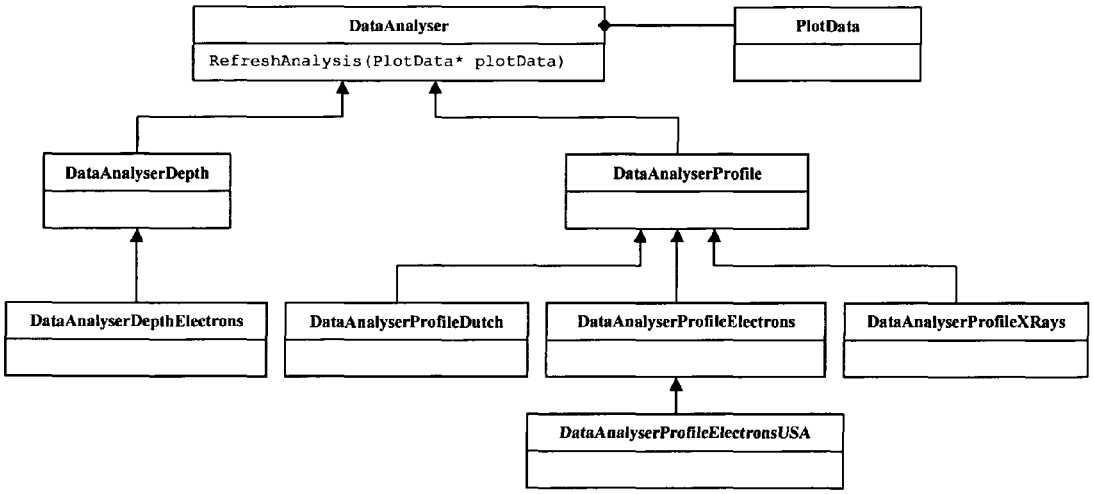
FIG. 11 is a DataAnalysis Class Relationship diagram.
Figure 12:
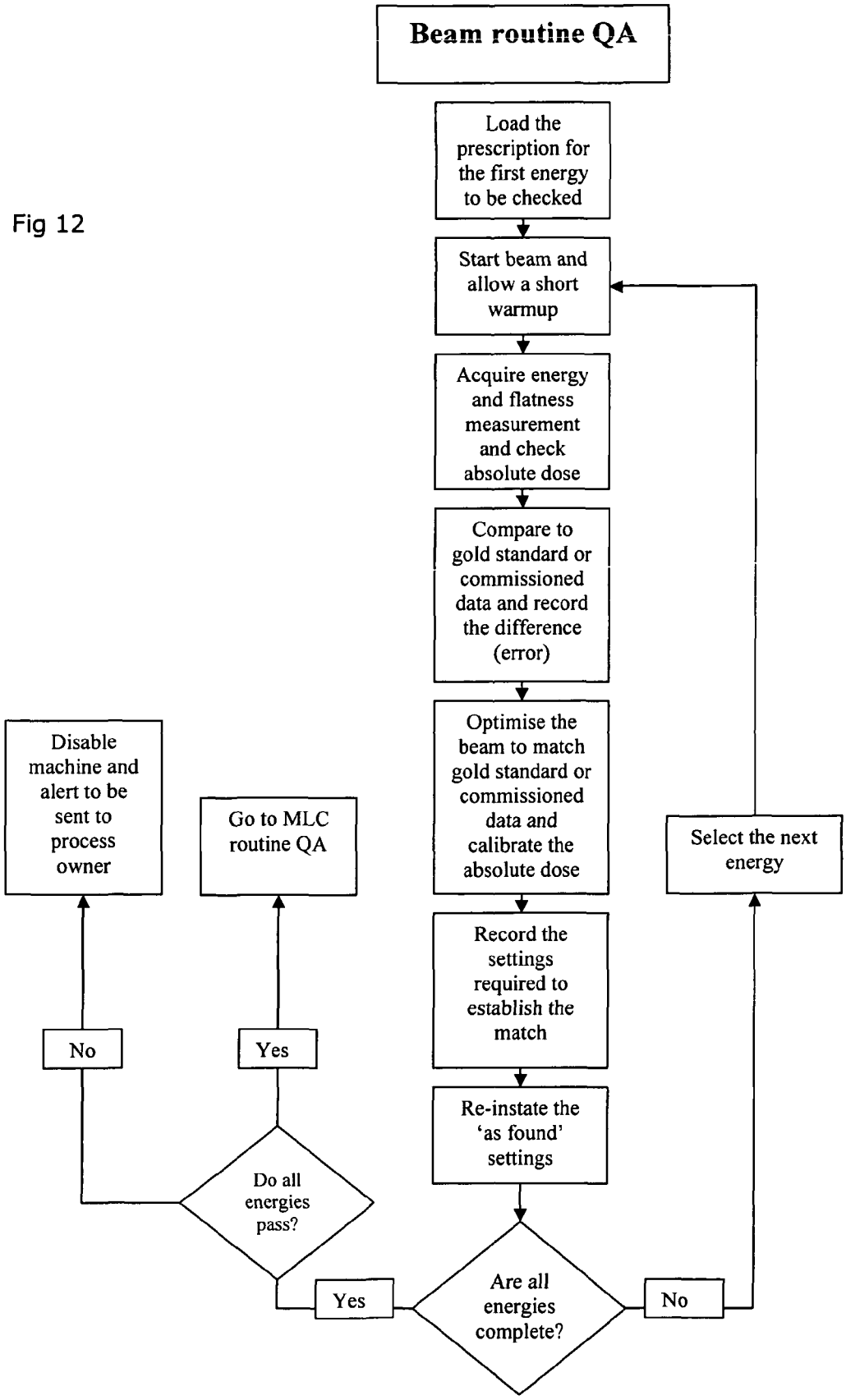
FIG. 12 illustrates the beam test process.
Figure 13:
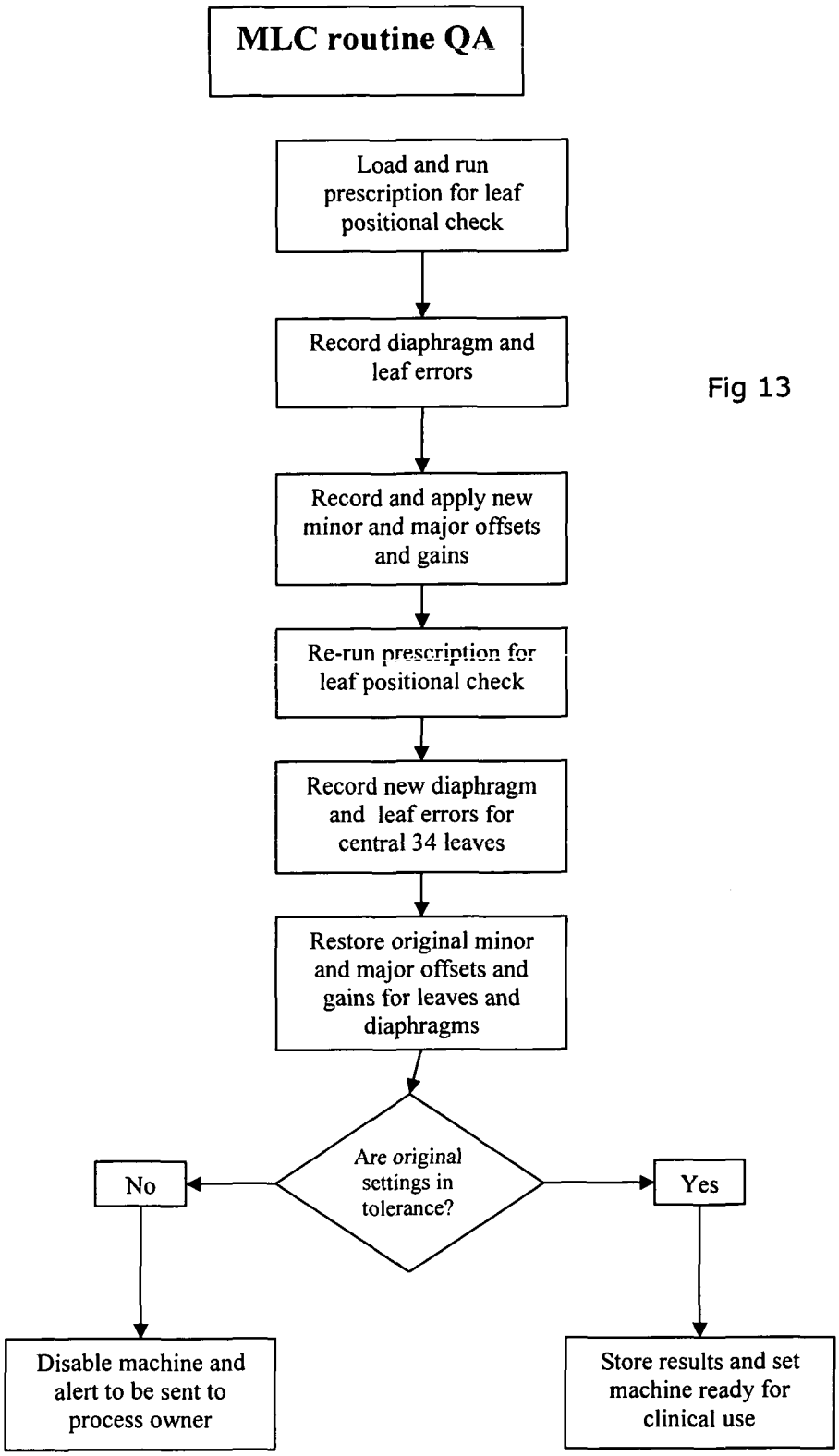
FIG. 13 illustrates the MLC test process.

Functions such as these can be used directly by the test modules, or by the DataAnalyser classes also found in this library (shown in FIG. 11). These classes provide an analysis of the plot data, including a pass/fail result for a required specification (at present Standard, USA or Dutch depending on the scan type). Both the DataAnalysis control and the XrayEnergyAndFlatness test module use the DataAnalyser classes to provide the analysis for individual and group plots.

7.2 FileManager

As the name suggests, the FileManager.dll library contains the classes used for managing all data to and from file. The types of files used are:

| File Type | Use |
|---|---|
| *.XML | Used for the test module header files. Contains information such as:<br>Module name<br>Energy type and level that the module was run at<br>Linear accelerator serial number<br>The filenames of all plot data files associated with this module<br>Module analysis as text.<br>Linear accelerator item part values required for AutoAnalysis |
| *.DAT | Used to store the XY plot data for an individual plot. They also contain a small amount of header information regarding the type of plot that the data pertains to i.e.:<br>Scan Type<br>Energy type and level<br>Date/time |
| *.INI | These are used by the test modules to contain some of the parameters required for the test. Each test module has its own respective *.INI file, some of which are updated as the test is run (i.e. Achromaticity). |
| *.LOG | All information written to the DataMonitor control gets automatically written to an event log. There is also an error log file for diagnostic purposes. |

The *.DAT files will only contain data for a single plot. When a user views a group of plot results from a test module, they are viewing the *.XML file, which in turn references the correct data files to load into the GUI. The header information in the data files is handled by the DataFileHeader classes ScanDataFileHeader and IVPlotDataFileHeader. The XY plot data, however, is loaded and saved directly into the PlotData class by the PlotData class itself.

8 Other User Controls

To help maintain a modular design, the larger user interface controls seen within the GUI are implemented as discrete components residing in their own assemblies. Some of these are copies of existing applets within the linac software.

8.1 AutotestGraphicalDisplay

This component is used to bridge the gap between the main graph and all other classes. It contains functions for displaying arrays of data as plots without classes having to interact with the concrete graph classes themselves. The graphical display is likely to change with future updates of Autotest which this class helps to facilitate.

8.2 NewAutotestForm

All forms within the project inherit from the NewAutotestForm. This class restricts the forms movement and cursor movement on a closed system. In addition to this, the NewAutotestForm.dll contains the following classes:

| Class | Purpose |
|---|---|
| NewAutotestMessageBox | All message boxes implement this class which prevents the window from being moved off screen on the closed system. |
| NewAutotestModuleForm | Inherits from the NewAutotestForm class and provides virtual functions for setting the Energy Type and a reference to the TestInterfaceClient. |
| NewAutotestStatusBar | Along with the NewAutotestStatusBarPanel, this allows the main application to set the colour of panels in the status bar. |
| ProgressIndicatorHandler | By using the ProgressIndicator class, the ProgressIndicatorHandler allows the test modules to display a progress indicator for when the linear accelerator is interrupted or waiting for dose recovery, etc. Although the progress indicator appears as a form, it is in fact a control that is attached to the main form. This is required due to restrictions imposed by the linac software WinMan component. |

8.3 DataAnalysis

The DataAnalysis control uses a hierarchy of helper classes in order to analyse the data according to the criteria required. This is required as the analysis differs depending on the energy type and protocol selected (i.e. USA Flatness, Dutch, etc). The component makes extensive use of the DataAnalyser set of classes described earlier. This is to maintain consistency between the analysis given by the GUI and that provided by the test modules.

8.4 DataMonitor

This provides the user continual feedback regarding the state of the module currently being run and is updated by the test modules each time they write to the event log. In addition to this, the majority of test modules utilise this component to display item part values that are currently being altered by the module. It also provides a read-only version of the Beam Monitor service page.

8.5 GraphLegends

This is a simple component that handles the list of plots loaded into the GUI.

8.6 ItemPartTextBox

Used by several other user interface components, the ItemPartTextBox control contains a reference to the TestInterfaceClient allowing it to handle the writing of item part values to the Linac. Within the designer, a user can set properties for the item number, item part, etc leaving the component to format the value. This formatting is also used (by the ServicePages for example) to format item part values read from the Linac via the TestInterfaceClient.

8.7 MenuExtender

This implements the IExtenderInterface in order to add icons to menu items.

8.8 QuickBeam

This is designed to act in a manner similar to the QuickBeam applet within the linac software. Both this component and the test modules need to load a beam via the TestInterfaceClient. However, the TestInterfaceClient does not provide a means of knowing which beam is currently loaded. To prevent the test modules reloading beams that are already loaded by this applet, an instance of the TestInterfaceClient is passed between the main GUI, QuickBeam and the test modules as they are run. The other components that reside on the main user interface create their own instance of the TestInterfaceClient.

8.9 ServiceFunctions

Provides some of the service functions that are present within the current linac software.

8.10 ServicePages

Provides some of the service pages that are present within the current linac software including the readback of the MLC. This component relies on a separate library of pages that reside in Pages.dll.

9 Tools

The Autotest GUI has been developed to allow additional test tools to be loaded via the tools menu item. This process is described further in section 9.3.

9.1 AutoAnalysis

AutoAnalysis allows the user to compare the linear accelerator settings of any previously saved results with the current linear accelerator settings so the user can assess whether the results are still valid. The back-end database contains three tables that are relevant to this tool:

| Table | Purpose |
|---|---|
| IPVs | Contains lists of all the item part values that need to be checked for each module at each energy level. |

-continued

| Table | Purpose |
|---|---|
| Test Modules (ELECTRONS) | Contains the module status and item part value check status for each electron test module. This also contains the filename of the module header file that was copied into the Autotest Final directory. |
| Test Modules (X_RAYS) | Contains the module status and item part value check status for each x-ray test module. This also contains the filename of the module header file that was copied into the Autotest Final directory. |

The check between module IPVs (Item Part Values) and values stored in the linear accelerator database is made each time AutoAnalysis is launched. The last two tables in the above list (Test Modules (ELECTRONS) and Test Modules (X_RAYS)) are updated as this occurs; the IPV_CHECK field is given a value relating to whether or not the IPV check has either passed or failed. As can be seen by examining the database tables, the actual item part values are not recorded in the database (they have already been stored—in the module header file and the calibration database). AutoAnalysis provides a 'live' update of the item part values based on the values stored in the database.

9.2 Backups

The Backups add-on tool allows the files to be backed up across the network, the tool maps the network drives as it is launched using the NET.exe utility.

9.3 MachineConfiguration

The MachineConfiguration add-on tool reads the linear accelerator license to determine the energy configuration of that particular linear accelerator and permits access to all relevant tests/modules or prevents access to invalid tests or modules. It also allows the user to select different analysis protocols.

However, unlike the AutoAnalysis tool, the MachineConfiguration utility needs to run each time the software loads on a closed system. To add a degree of flexibility regarding the initialisation of New Autotest, the main GUI contains code that permits additional code to be run when the application is launched. This is detailed further in section 9.2. With regards to the MachineConfiguration tool, the static method CheckMachineConfiguration checks the Linacs current license key and serial number so that it can re-configure the AutoAnalysis database should either of these two change.

9.4 Matching

The matching tool allows groups of plots to be matched and analysed. Each matching configuration is saved in a *.mcfg file which contains serialized data in the form of an ArrayList. The ArrayList contains one MatchingManager class per matching group in addition to file location and energy information. The MatchingManager class contains a list of MatchedPlot classes that relay file information for each matched plot.

10 Launching New Autotest

New Autotest is always launched via an out of process component that can run an integrity check on files before the main executable is run. There are two launching utilities—one for launching New Autotest on a Closed System and one for launching New Autotest on a standalone PC. Both of these check each file required by Autotest to ensure that the current version of the software is valid.

Three criteria must be satisfied before the software can be launched:

That no additional files have been introduced into the New Autotest directories.

That files in the New Autotest directories are still valid (by verifying the file checksum using the CRCGenerator component).

That there are no files missing from the New Autotest directories.

To accomplish this, two files reside in the New Autotest directory:

| File | Purpose |
|---|---|
| New Autotest CRCs.lst | Contains a list of filenames with their corresponding check sum values. Every file (not listed in Exempt Files.lst) must be present and pass the CRC (Cyclic Redundancy Check). |
| Exempt Files.lst | Contains a list of files that are exempt from CRC checking. These are files that are expected to change, such as database files and log files. |

The New Autotest CRCs.lst file will need to be updated each time a test module or add-on tool is added.

10.1 Launching New Autotest on a Closed System—NewAutotestLauncher

When run on a closed system (such as a cabinet connected to a Linac), New Autotest is launched via the NewAutotestLauncher component that is loaded into the linac software. This component is installed via the New Autotest installation program (described in section 8) along with the additional icon on the linac toolbar.

Both the NewAutotestLauncher and CRCGenerator DLLs are compiled as public assemblies that reside in the Global Assembly Cache. This is a requirement from the linac software in order for the NewAutotestLauncher to be loaded.

10.2 Launching New Autotest on a Standalone PC—Autotest Viewer

On a standalone PC, New Autotest is launched via the Autotest Viewer executable. When the New Autotest installation program is run (described in section 8) shortcuts are created that link directly to this application. The Autotest Viewer itself checks the integrity of all files required by New Autotest (in a manner identical to the NewAutotestLauncher component) and if the check passes, launches the main New Autotest program. If the integrity check fails, then a form is shown detailing the failures.

To prevent a user from running the Autotest executable directly (bypassing the integrity check) a flag is set in the system registry by the launcher if the CRC check was successful. New Autotest checks this flag before the call to the main windows constructor. The flag is also reset at this point ready for the next launch.

11 New Autotest Extensibility

The New Autotest application has been designed so that it can be extended without re-compiling core components. This applies to three main areas: the Test Modules (described in section 4.3), initialisation code and the add-on tools (section 6).

Provisional work has also been done to allow the interface to the scanning hardware to be changed (and hence the scanning hardware itself), which was detailed in sections 4.1 and 4.2. In fact, provided the public interfaces do not change, any component in any private assembly can be updated without the need for re-compiling the main software.

The IPVs table in the AutoAnalysis database can be updated at any time to instruct a test module to save additional item part values at the end of a test. By setting the Analyse field to Yes, this will also instruct AutoAnalysis to check the item part value with that residing in the database.

11.2 Adding Initialisation Code

The New Autotest software allows additional code to be run as initialisation code. The method frmMain::RunInitialisationCode within the New Autotest GUI opens the file Initialisation Code.lst that contains details of any static methods in assemblies that should be run as the application starts up. Further initialisation code can be run by adding a static public method to any class in any library.

11.3 Add-on Tools

Additional tools can be launched by the New Autotest GUI via its tools menu item. To add a tool, the component must provide a class that inherits from the abstract AddonTool class. Once compiled, place the tool in the Autotest Tools directory so that it can be attached to the tools menu.

12 Version Control

As detailed in section 9, New Autotest has been designed with expansion in mind: the main GUI loads each test module in dynamically and not only has no knowledge of which file versions should be run, but also has no knowledge of how many tests there are. To ensure that only the correct tests are run, all required files are integrity checked before the software is launched using the CRC file (launching is described in section 7).

The CRC file contains a serialised Hashtable that contains filename-checksum pairs for each file that needs to be checked. In addition to this, when the CRC file is generated (using the Factory Project Builder tool described in section 11.1) the first few entries of the hashtable a filled with special values. These are:

The date the CRC file was generated.

A build number to accompany the CRC file.

The part number for the Autotest software.

Thus, all files required by New Autotest are tied to a build number embedded into the CRC file: adding or replacing files in the New Autotest directories will prevent the main application from being be launched unless accompanied by an updated CRC file.

13 Development Tools

A small number of additional tools have been created in order to develop the Autotest project.

13.1 Factory Project Builder

This utility ensures that the project is built according to the Software Configuration Management plan for New Autotest 13.2 FileVersionUpdater This is a command line utility that is added as a pre-build event to every project. It is used to update the FILEVERSION resource in the project so that the file version number appears when viewing the file in windows Explorer. This file version attribute is also utilised by the NewAutotestLauncher component to display the versions of files within the New Autotest directories.

The tool is required as all components (except the NewAutotestLauncher and CRCGenerator) are compiled as private assemblies and as such, are not strongly named.

14 Test Process

A standard QA check of the full therapeutic linac consists of a beam check followed by a check of the MLC (multi-leaf collimator) used to shape the beam to a desired profile.

14.1 Beam Test

The beam test allows for the fact that the linac may be capable of a number of preset energy levels. The changes necessary to produce a beam of a different energy can affect the beam properties and therefore checks are carried out in sequence on each energy.

Thus, a first energy is selected and the beam established. Details are obtained of the beam energy, the beam flatness, and the absolute dose. These are compared to a retained set of properties, which can be a known gold standard or a target standard which it is desired that the linac should replicate. Where discrepancies are found, these are corrected in order to return the linac to the chosen standard. The adjustments necessary to achieve this are then recorded, and the previous settings re-instated so that (by default) patients arriving for treatment after the recalibration receive the expected dose. These adjustments are however reported to an operator so that a decision can be made as to whether the adjustments should be made permanent or discarded.

This is then repeated for each beam energy. Once all are done, the results are checked to confirm that the divergence was within a permitted tolerance; if not then the linac is disabled and an alert is sent to the operator. If all is well then the MLC test is begun.

The record of necessary adjustments can be used for diagnostic purposes. Where these exceed a threshold then, obviously, a warning needs to be issued and the linear accelerator disabled. However, if a lower threshold is exceeded a note could be sent to a remote operator such as a service engineer or the manufacturer. This information could be used to schedule other maintenance work for a convenient time and/or to provide advance warning of forthcoming issues.

14.2 mLC Test

This involves variation of the leaf positions according to a preset prescription and observation of the effect of this on the measured beam.

15 Appendix 15.1 Databases

The New Autotest application uses a number of databases. Some of these databases relate to individual test modules—they will not be described here.

| Database | Purpose | Integrity Checked |
|---|---|---|
| AutoAnalysis.mdb | Described in section 6.1. | No |
| EnergyTables.mdb | Contains the electron depth dose conversion tables, the default energy reference depth tables and the default test module tables. | Yes |
| IonChambers.mdb | Used by the Manual Scanning Control for the Buddelship to store the calibration factor for different Ion chambers. | No |
| LeafShapes.mdb | Contains the leaf and diaphragm positions for MLC shapes required by New Autotest. | Yes |

An additional database is used by Wellhoffer's OP-Industrial software. On a Closed System, the user will not have direct access to OP-Industrial, and so the database is modified by the ServoClient component. Although installed by Wellhoffer's installation program, this database, Platform.mdb, is replaced by a pre-configured version when New Autotest is installed.

It will of course be understood that many variations may be made to the above-described embodiment without departing from the scope of the present invention.

The invention claimed is:

1. A radiotherapy system comprising:

a linear accelerator arranged to produce a beam of radiation;

beam control circuitry for the linear accelerator;

an electronic control apparatus for the control circuitry, arranged to adjust properties thereof; and a monitor for detecting properties of the radiation beam produced by the linear accelerator, wherein the monitor is located in the path of the radiation beam and wherein the control apparatus is configured to retain a set of beam properties and periodically perform steps to a) activate the accelerator, b) measure the current beam properties via the monitor, c) compare the measured beam properties to the retained beam properties, and d) adjust the control circuitry properties to align the beam properties towards the retained beam properties.

2. The system according to claim 1 in which the control apparatus is configured to perform steps (a) to (d) after a period of normal operation.

3. The system according to claim 2 in which the steps (a) to (d) are followed by a further period of normal operation, after which the control apparatus repeats performing steps (a) to (d).

4. The system according to claim 1 in which the control apparatus is additionally configured to, prior to step (d), record properties of the control circuitry and to, after step (d), return the control circuit to a state having the recorded properties.

5. The system according to claim 1 in which the beam properties include at least one property of beam flatness and beam width.

6. The system according to claim 1 in which the retained beam properties are the properties of the beam produced by the linear accelerator when the linear accelerator is new.

7. The system according to claim 1 in which the retained beam properties are the properties of a standard beam.

8. The system according to claim 1 in which the control apparatus is arranged to send a message if the difference between the measured beam properties and the retained beam properties exceeds a threshold.

9. The system according to claim 8 in which the control apparatus is arranged to send a message to a remote location if the difference between the measured beam properties and the retained beam properties exceeds a second threshold that is more demanding than the first threshold.

10. A method of operating a radiotherapy system that comprises a linear accelerator arranged to produce a beam of radiation, beam control circuitry for the linear accelerator, an electronic control apparatus for the control circuitry, arranged to adjust properties thereof, and a monitor for detecting properties of the radiation beam produced by the linear accelerator, the method comprising periodically performing the steps of a) locating the monitor in the path of the radiation beam, b) activating the accelerator, c) measuring the current beam properties via the monitor, d) comparing the measured beam properties to the retained beam properties, and e) adjusting the control circuitry properties to align the beam properties towards the retained beam properties.

11. The method of claim 10 comprising performing steps (b) to (e) after a period of normal operation.

12. The method of claim 11 further comprising, after steps (b) to (e) are followed by a further period of normal operation, the control apparatus again performing the steps (b) to (e) again.

13. The method of claim 10 further comprising, prior to step (e), recording properties of the control circuitry and, after step (e), returning the control circuit to a state having the recorded properties.

14. The method of claim 10 in which the beam properties include at least one property of beam flatness and beam width.

15. The method of claim 10 in which the retained beam properties are the properties of the beam produced by the linear accelerator when the linear accelerator is new.

16. The method of claim 10 in which the retained beam properties are the properties of a standard beam.

17. The method of claim 10 comprising sending a message if the difference between the measured beam properties and the retained beam properties exceeds a threshold.

18. The method of claim 17 comprising sending a message to a remote location if the difference between the measured beam properties and the retained beam properties exceeds a second threshold that is more demanding than the first threshold.

* * * * *